US006802602B2

(12) United States Patent
Sakai et al.

(10) Patent No.: US 6,802,602 B2
(45) Date of Patent: Oct. 12, 2004

(54) INK CARTRIDGE AND INK JET RECORD APPARATUS USING INK CARTRIDGE

(75) Inventors: Yasuto Sakai, Nagano (JP); Kenji Tsukada, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/304,055

(22) Filed: Nov. 26, 2002

(65) Prior Publication Data

US 2003/0103119 A1 Jun. 5, 2003

(30) Foreign Application Priority Data

Nov. 26, 2001 (JP) ..... P2001-359232
Oct. 21, 2002 (JP) ..... P2002-305861

(51) Int. Cl.[7] ..... B41J 2/175
(52) U.S. Cl. ..... 347/86
(58) Field of Search ..... 347/7, 85, 86, 347/87, 92; 116/227; 137/557

(56) References Cited

U.S. PATENT DOCUMENTS 5,689,288 A 11/1997 Wimmer et al.
6,536,861 B1 * 3/2003 Usui et al. ..... 347/7

FOREIGN PATENT DOCUMENTS

| | | |
|---|---|---|
| EP | 0 660 092 A1 | 4/1988 |
| EP | 1 053 877 A1 | 11/2000 |
| EP | 1 053 877 | 11/2000 |
| JP | 62-261447 | 11/1987 |
| JP | 10-329330 | 12/1998 |
| JP | 2001-328278 | 11/2001 |
| WO | WO 96/11385 | 4/1996 |

OTHER PUBLICATIONS

Japanese Abstract No. 2001328278, dated Nov. 27, 2001.

* cited by examiner

*Primary Examiner*—Anh T. N. Vo
(74) *Attorney, Agent, or Firm*—Sughrue Mion, PLLC

(57) ABSTRACT

An ink cartridge comprises a container main body 2 storing ink and having a through hole 67 communicating with the atmosphere as the ink cartridge is placed in a record apparatus, and a liquid level sensor 61 being disposed in the vicinity of a corner in the container main body 2 for detecting the ink level. A partition wall 62 to cover the liquid level sensor 61 is disposed in the container main body 2. An upper gap 63 into which an air bubble occurring with ink consumption can be introduced and a lower gap 64 positioned below the upper gap 63 are formed between the partition wall 62 and the inner face of the container main body 2, and a sensor accommodation area 65 communicating with both the gaps 63 and 64 to destroy the air bubble is formed.

27 Claims, 11 Drawing Sheets

INK CARTRIDGE AND INK JET RECORD APPARATUS USING INK CARTRIDGE

BACKGROUND OF THE INVENTION

This invention relates to an ink cartridge for supplying ink to a head of a record apparatus.

Patent Document 1 proposes attaching a sensor comprising a piezoelectric vibrator to a side of an ink container so that the piezoelectric vibrator is contactable with ink. The detection is made as to whether or not ink exists above the piezoelectric vibrator, based on the difference between residual vibration when the piezoelectric vibrator comes in contact with ink and that when the piezoelectric vibrator is exposed to the atmosphere.

Since an air bubble has an intermediate characteristic between liquid and the atmosphere, the residual characteristic of the piezoelectric vibrator becomes unstable, causing a detection mistake.

To solve such a problem, Patent Document 2 discloses placing a wall extending in a horizontal direction in an area in which a liquid level sensor is accommodated for preventing an air bubble from coming in direct contact with the liquid level sensor.

Patent Document 1: JP-A-2001-328278
Patent Document 2: European Patent Application Publication No. 1053877 page 42 paragraph 320, FIG. 79

However, ink has a component containing a surface active agent, etc., and thus if a large amount of ink is consumed in a record head as an image is printed, etc., an air bubble occurs because of the atmosphere entered through an atmospheric communication hole, causing a large amount of bubbles accumulated to adhere onto the sensor. Since a bubble has an intermediate characteristic between liquid and the atmosphere, the residual characteristic of the piezoelectric vibrator becomes unstable, causing an ink level detection mistake.

SUMMARY OF THE INVENTION

It is therefore an object of the invention to provide an ink cartridge for making it possible to prevent a detection mistake caused by adhesion of a bubble caused by an air bubble occurring in ink, to thereby stably detect the ink level or ink amount.

To the end, according to the invention as claimed in claim 1, there is provided an ink cartridge comprising: a container having at least one ink chamber storing ink therein; a partition wall disposed in the container, and defining a sensor accommodation area in a part of the ink chamber, the partition wall further defining an upper gap and a lower gap through which the sensor accommodation area is in fluid communication with another part of the ink chamber; and a liquid level sensor comprising a piezoelectric element, which is disposed in the sensor accommodation area. The upper gap blocks entry of a bubble as it is into the accommodation area, and enlarges and destroys the bubble if the bubble is pushed out into the accommodation area from the upper gap.

Because of the configuration, before the flow force of a bubble exceeds the limit of the capillary force produced by the upper gap, if the bubble accumulates in the upper part in the ink chamber, it does not pass through the upper gap of the partition wall and is prevented from flowing into the sensor accommodation area. If the number of bubbles in the vicinity of the liquid surface increases and the flow force of the bubbles exceeds the limit of the capillary force of the gap, the bubbles moves from the gap to the inside of the sensor accommodation area while they are enlarged. In this process, the bubbles are destroyed. Therefore, the bubble is prevented from entering the sensor periphery and being collected at the sensor periphery, and erroneous detection of the liquid level by the piezoelectric element forming a part of the liquid level sensor is prevented.

In the invention as claimed in claim 4, a plurality of the partition walls are disposed to be separated one from another in a horizontal direction. Therefore, entry of the air bubble into the sensor accommodation area can be more positively prevented.

In the invention as claimed in claim 5, the partition wall is disposed so that a part of the accommodation area in the vicinity of the upper gap is spread and enlarged toward the liquid level sensor. Therefore, the bubble is easily expanded and then destroyed when the bubble passes through the upper gap.

In the invention as claimed in claim 6, the upper gap is set to a dimension of 0.5 mm to 1 mm, so that the bubble accumulated in the upper part in the cartridge main body is prevented from directly moving to the sensor accommodation area and if the bubble moves to the sensor accommodation area, it is swollen and is reliably destroyed.

In the invention as claimed in claim 11, the distance between the upper gap of the partition wall and the liquid level sensor is set to 8 mm or more, so that the bubble can be destroyed before it adheres to the sensor.

The present disclosure relates to the subject matter contained in Japanese patent application No. P2001-359232 (filed on Nov. 26, 2001) and P2002-305861 (filed on Oct. 21, 2002), which are expressly incorporated herein by reference in their entireties.

DESCRIPTION OF THE PREFERRED EMBODIMENT

Referring now to the accompanying drawings, there are shown preferred embodiments of an ink cartridge and an ink jet record apparatus using the ink cartridge incorporating the invention.

Figure 1:
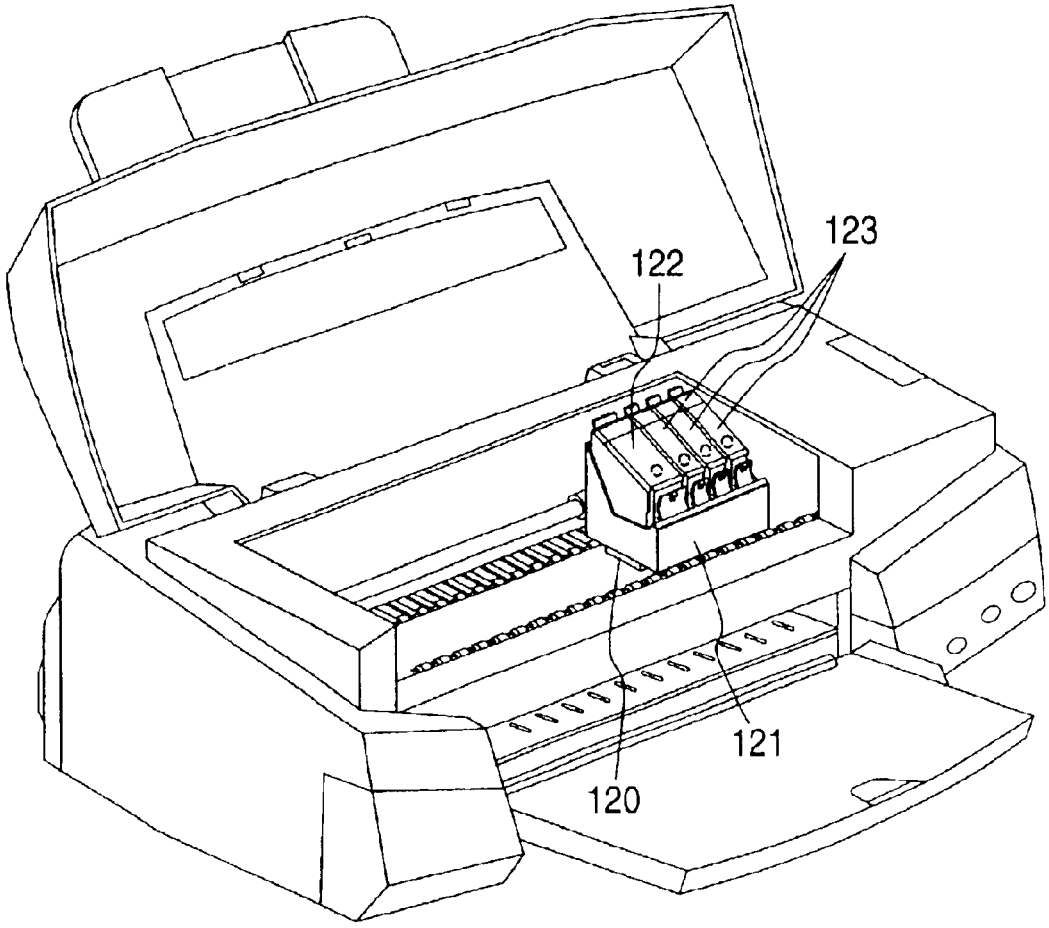
FIG. 1 is a perspective view to show an outline of the basic configuration of an ink jet record apparatus according to an embodiment of the invention.

FIG. 1 is a perspective view to show an outline of the general configuration of an ink jet record apparatus according to an embodiment of the invention. A black ink cartridge 122 and color ink cartridges 123 for supplying ink to an ink jet record head 120 are detachably placed on the top face of a carriage 121 with the ink jet record head 120 placed on the bottom face of the carriage. The color ink cartridge 123 is narrower in width than the black ink cartridge 122.

Next, one embodiment of the ink cartridge described above will be discussed by taking a color ink cartridge as an example.

Figure 2:
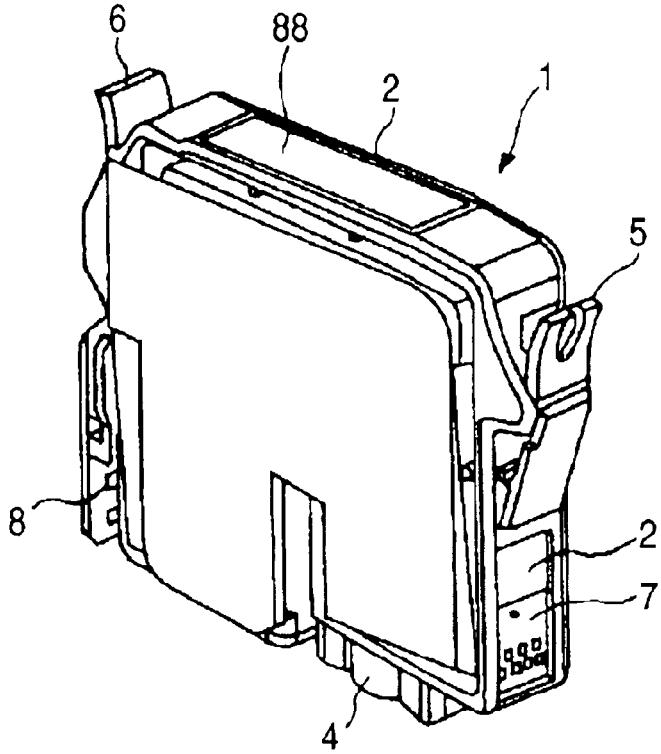
FIGS. 2(*a*) and 2(*b*) are perspective views to show the appearance of an ink cartridge according to a first embedment of the invention.
Figure 2:
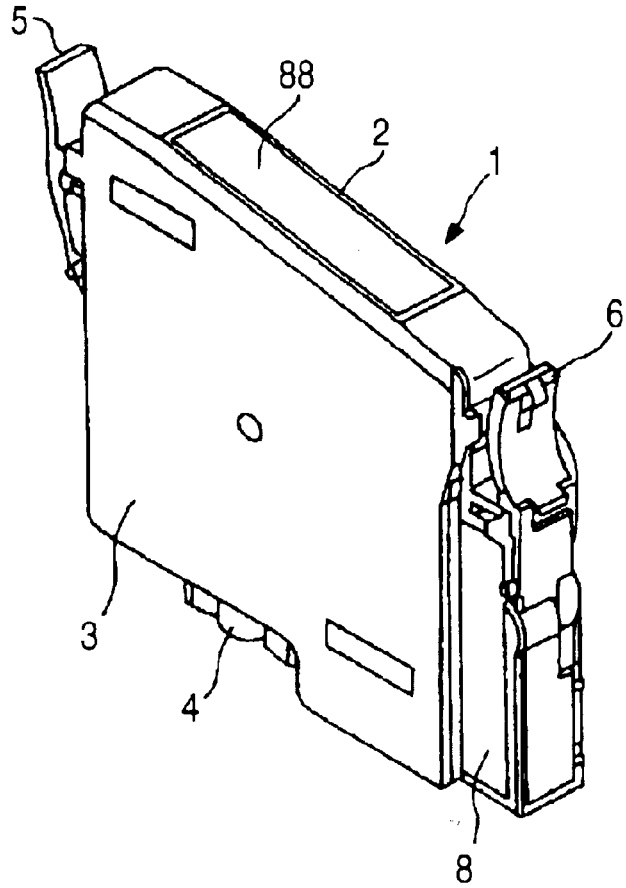

FIGS. 2(*a*) and 2(*b*) are perspective views to show the appearance of an ink cartridge according to a first embedment of the invention. A container main body 2 having a plane shape almost like a rectangle opened to one side, and a lid 3 for sealing the opening of the container main body 2 make up a container for storing ink.

The container main body 2 is formed at the bottom with an ink supply port 4 that can be connected to a hollow ink supply needle (not shown) communicating with the record head and on upper sides with a retention member 5 that can be attached to and detached from the carriage of the record apparatus and a grip member 6, the retention member 5 and the grip member 6 being placed integrally with the container main body 2. Memory means 7 is disposed below the retention member 5, and a valve accommodation chamber 8 is disposed below the grip member 6.

A valve body (not shown) opened and closed as the ink supply needle is inserted and removed is accommodated in the ink supply port 4.

Figure 3:
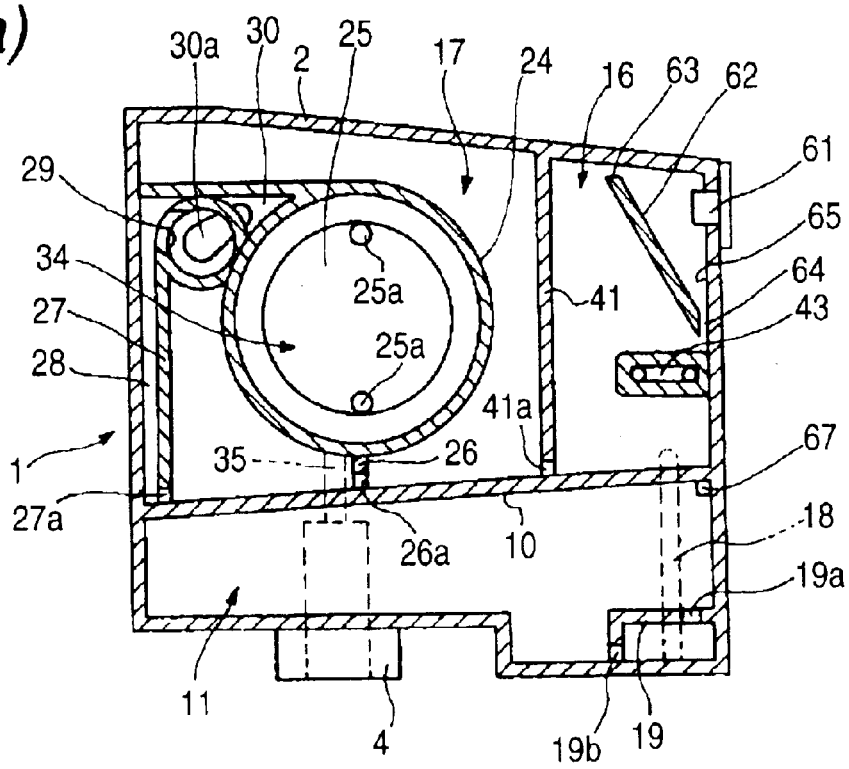
FIGS. 3(*a*) and 3(*b*) are sectional views to schematically show the internal structure of the ink cartridge according to the embodiment of the invention.
Figure 3:
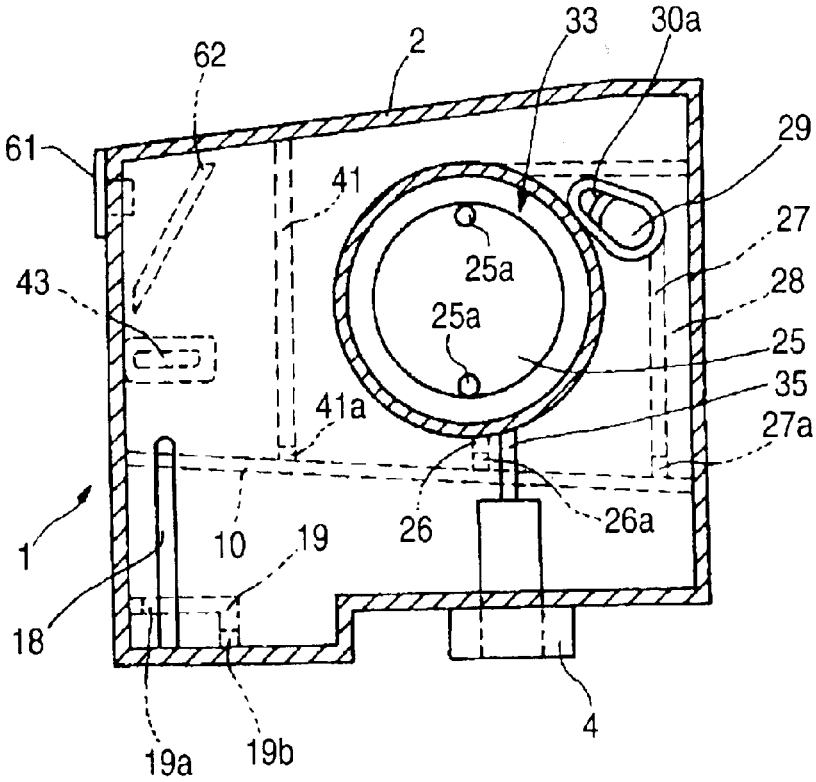
Figure 4:
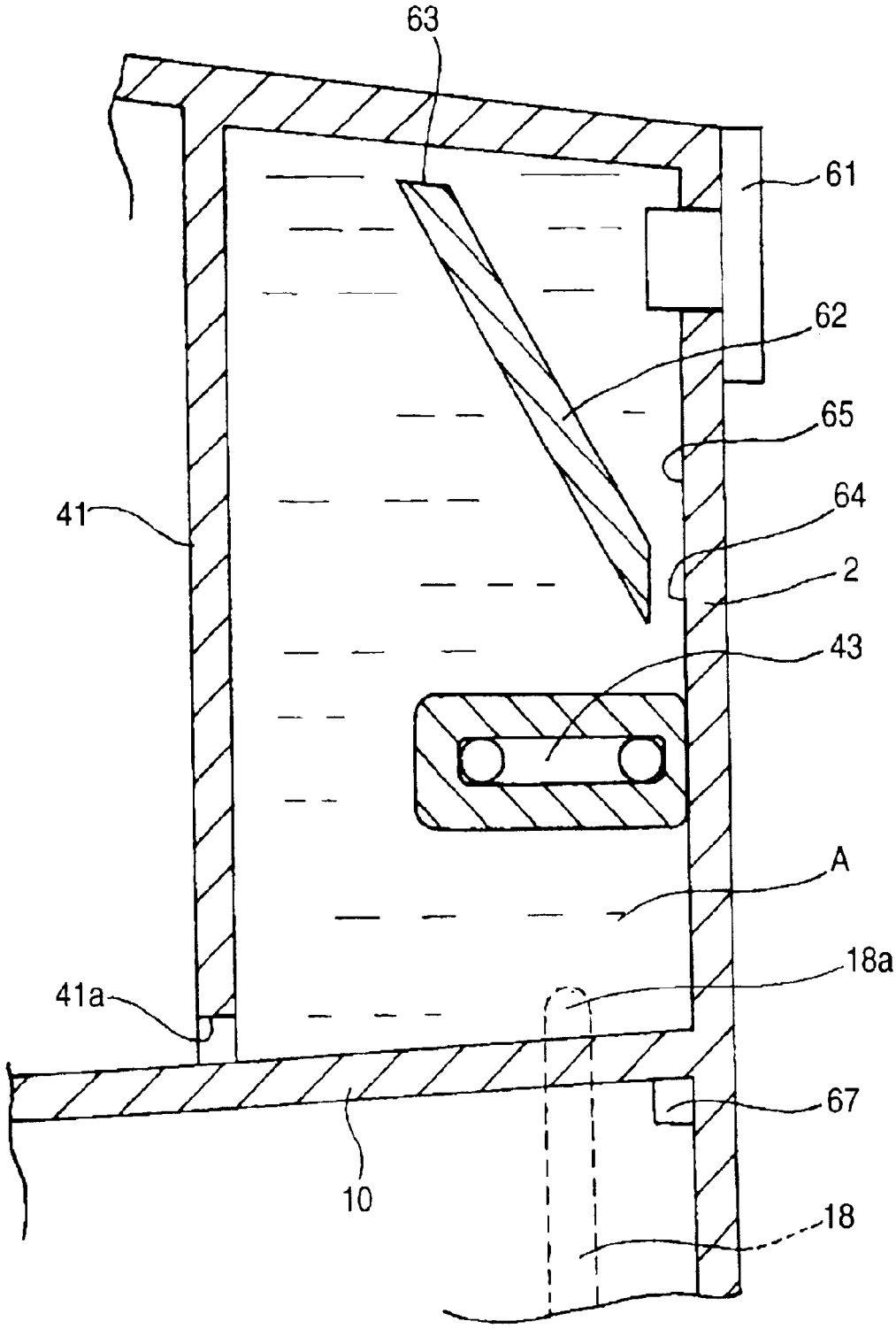
FIG. 4 is a sectional view to show the sensor accommodation area and the proximity thereof in the ink cartridge on an enlarged scale in FIG. 3(*a*)

Next, the internal space of the container main body 2 (the inside of the ink cartridge) will be discussed with FIGS. 3(*a*) and 3(*b*) and FIG. 4. FIGS. 3(*a*) and 3(*b*) are sectional views to schematically show the internal structure of the ink cartridge according to the embodiment of the invention. FIG. 4 is a sectional view to show the main part of the ink cartridge according to the embodiment of the invention on an enlarged scale.

As shown in FIGS. 3(*a*) and 3(*b*), the internal space of the container main body 2 is divided into upper and lower portions by a partition wall 10 extending so that the ink supply port side of the partition wall 10 is slightly downward in a gravity direction when the ink cartridge is connected with respect to the record head. The lower portion area of the internal space serves as a lower ink storage chamber 11 opened to the atmosphere in a cartridge connection state to the record head. On the other hand, the upper portion area serves as a first upper ink storage chamber 16 and a second upper ink storage chamber 17 positioned above the lower ink storage chamber 11. The upper ink storage chambers 16 and 17 are adjacent to each other with a vertical wall 41 interposed therebetween. The vertical wall 41 is formed in a lower part with a communication port 41*a* opened laterally.

A compartment 19 communicating with the first upper ink storage chamber 16 via a communication flow passage 18 is formed in the lower ink storage chamber 11. Accordingly, ink from the compartment 19 rises in the communication flow passage 18 to flow toward and into the first upper ink storage chamber 16 (see ink A in FIG. 4). The compartment 19 is provided with an upper communication port 19*a* opened to the upper area of the lower ink storage chamber 11 and a lower communication port 19*b* opened to the lower area of the lower ink storage chamber 11.

The lower ink storage chamber 11 is formed in an upper part with a through hole (open port) 67 communicating with the atmosphere via an air flow passage (an area 43, etc.,) when the cartridge is placed on the carriage 121 of the record apparatus. Accordingly, when the ink cartridge 1 is placed in a cartridge holder, the atmosphere is introduced into the most upstream ink storage chamber, the lower ink storage chamber 11 in this embodiment, via the air flow passage.

In the cartridge of this embodiment, hole diameters of hole sizes of the lower communication port 19*b* and the communication port 41*b* are set so that ink is consumed in order of the lower ink storage chamber 11, the first upper ink storage chamber 16 and the second upper ink storage chamber 17.

The first upper ink storage chamber 16 is placed upstream from the second upper ink storage chamber 17 and downstream from the lower ink storage chamber 11. A liquid level sensor 61 facing the vertical wall 41 and positioned above the through hole 67 is attached to the proximity of the upper corner (side wall) in the first upper ink storage chamber 16. The liquid level sensor 61 has a piezoelectric element for detecting the ink level in the first upper ink storage chamber 16.

Figure 5:
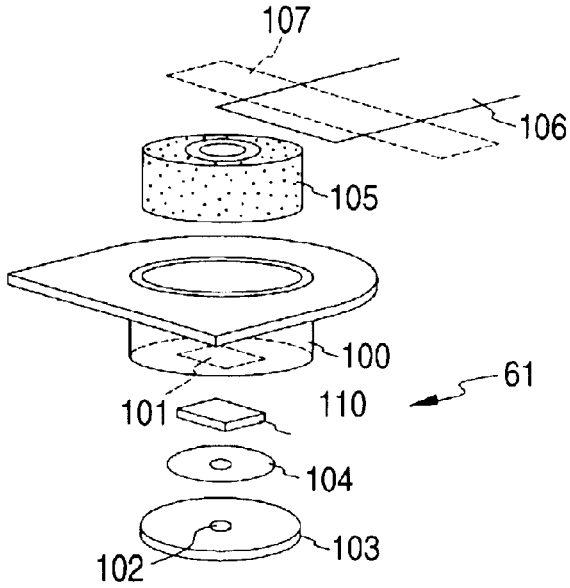
FIG. 5 is a perspective view of assembly to show one embodiment of a liquid level sensor to be attached to the ink cartridge.

FIG. 5 shows one embodiment of the liquid level sensor 61. A case 100 is formed by drawing of metal or injection molding of a polymeric material as a closed-end tubular body formed at a bottom with a window 101 for exposing a sensor chip 110 (described later). A bottom plate 103 having such a through hole 102 that a piezoelectric element 116 of the sensor chip 110 can be exposed is fixed to the bottom face of the case 100 via an adhesion layer 104. The sensor chip 110 is placed to correspond in location to the window 101, and an anisotropic conductor 105 is accommodated in the case 100 so as to come in contact with the surface of the sensor chip 110.

A wiring board 106, such as a flexible cable, is placed on the surface of the anisotropic conductor 105, the anisotropic conductor 105 is fixed in a compression state with adhesive tape 107 with the intervention of a lid, etc., as required, and the wiring board 106 is drawn out to the surface of the cartridge, thereby forming the liquid level sensor 61.

Figure 6:
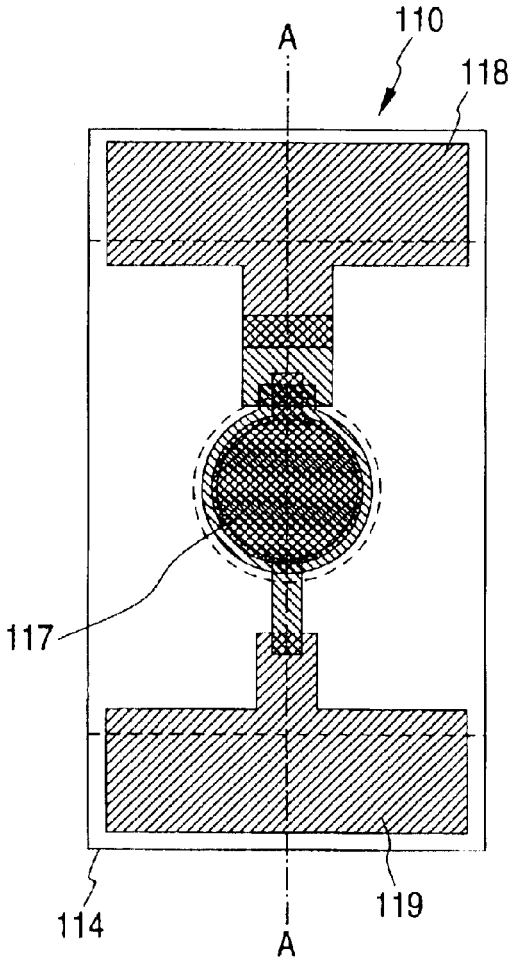
FIGS. 6(*a*) and 6(*b*) are a top view to show one embodiment of a sensor chip forming a part of the liquid level sensor and a sectional view taken on line A—A in FIG. 6(*a*)
Figure 6:
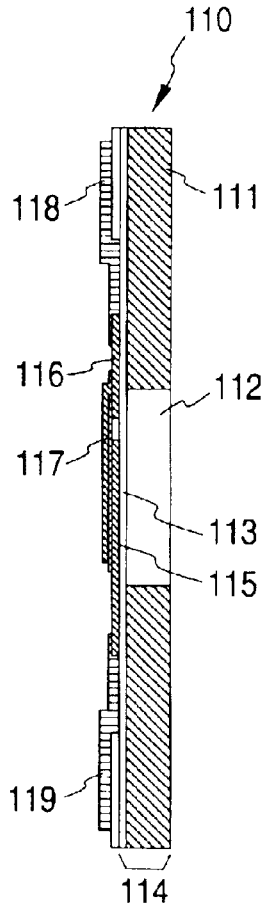

FIGS. 6(*a*) and 6(*b*) show one embodiment of the sensor chip 110. A through hole 112 is formed in the center of a plate member 111, and a vibration plate 113 is stacked on the outside face and is fixed for forming a board 114. A lower electrode 115, a plate-like piezoelectric element 116, and an upper electrode 117 are formed on the surface of the vibration plate 113, and the electrodes 115 and 117 are connected to connection terminals 118 and 119 formed so as to slightly project from other areas.

With the described liquid level sensor 61, when a drive signal is supplied to the piezoelectric element 116 and a vibration area of the vibration plate 113 and the piezoelectric element 116 is vibrated a predetermined number of times, residual vibration occurs from the point in time at which the drive signal is stopped, and a counter electromotive force occurs in the piezoelectric element 116. The residual vibration depends on change in the acoustic impedance caused by whether or not the vibration plate 113 and ink come in contact with each other. Therefore, the counter electromotive force is measured, whereby whether or not the vibration area of the liquid level sensor 61 is in contact with ink can be known. Thus, as ink in the first upper ink storage chamber 16 is consumed and the ink level drops below the vibration area of the ink sensor, at least the acoustic impedance difference caused by the level change is detected. Whether sufficient ink is stored or a given amount or more of ink is consumed in the first upper ink storage chamber 16 can be sensed.

Referring again to FIG. 3, a partition wall 62 covering the liquid level sensor 61 is disposed in the first upper ink storage chamber 16. The partition wall 62 divides the first upper ink storage chamber 16 into a sensor storage area 65 in which the liquid level sensor 61 is disposed, and another ink storage area. In this embodiment, the partition wall 62 is disposed to face the liquid level sensor 61. The partition wall 62 is formed as a wall having a gradient (about 35 degrees with respect to the sensor attachment face) rising toward the vertical wall 41 from a side wall of the first upper ink storage chamber 16 and having a width substantially corresponding to the depth (width) of the first upper ink storage chamber 16, namely, such a width that the wall 62 can serve as a partition for preventing entry of a bubble. In this embodiment, the partition wall 62 is constructed as a tilt rib molded integrally with the container main body 2. Accordingly, a bubble (shown in FIG. 7) occurring as ink is consumed can be guided from the lower side to the upper side and can be captured on the opposite side from the liquid level sensor 61. A sensor accommodation area 65 is formed between the partition wall 62 and inner walls (top wall and side wall) of the first upper ink storage chamber 16. The sensor accommodation area 65 has an upper gap 63 as a first gap and a lower gap 64 as a second gap. The area 65 accommodates a part of the liquid level sensor 61 and destroys the air bubble a passed through the upper gap 63.

The upper gap 63 is formed between the upper edge of the partition wall 62 and the upper wall of the first upper ink storage chamber 16. The upper gap 63 is set to a dimension of about 0.5 mm to 1 mm. Accordingly, before the flow force of a bubble a' outside the sensor accommodation area 65 (in the other ink storage area) exceeds the limit of the capillary force produced by the upper gap 63, namely, the holding force of a meniscus of ink formed in the upper gap 63, the bubble a' is not introduced into the sensor accommodation area 65 from the upper gap 63. If the flow force of the bubble a' exceeds the limit of the capillary force produced by the upper gap 63, the bubble a' is introduced into the sensor accommodation area 65 from the upper gap 63.

If the upper gap 63 is smaller than 0.5 mm, the bubble a' does not flow into the sensor accommodation area 65 from the upper gap 63 and remains accumulated in the upper part in the first upper ink storage chamber 16. On the other hand, if the upper gap 63 is larger than 1 mm, the bubble a' flows into the sensor accommodation area 65 from the upper gap 63 as it is, and adheres to the liquid level sensor 61.

On the other hand, the lower gap 64 is formed between the lower edge of the partition wall 62 and the side wall of the first upper ink storage chamber 16. The lower gap 64 is set to a dimension smaller than 0.5 mm. Accordingly, the bubble a' does not flow into the sensor accommodation area 65 from the lower gap 64, and only ink A flows so that the ink level in the sensor accommodation area 65 matches the ink level outside the sensor accommodation area 65 (in the other part of the first upper ink storage chamber 16). In this embodiment, since a communication port 18*a* of the communication flow passage 18, which is opened to the upper ink storage chamber 16 and through which air is introduced into the upper ink storage chamber 16, is disposed to be offset from the lower gap 64 toward the upper gap 63 in the horizontal direction, the lower gap 64 may be set to a larger dimension, preferably in a range of 0.5 mm to 3.0 mm.

The second upper ink storage chamber 17 is placed contiguous to the side part of the first upper ink storage chamber 16. In the second upper ink storage chamber 17, a filter chamber 34 is defined by an annular wall 24.

A differential pressure regulating valve accommodation chamber 33 is disposed at the rear of the filter chamber 34 with a partition wall 25 interposed therebetween as shown in FIG. 3(*b*). The differential pressure regulating valve accommodation chamber 33 is made to communicate with the ink supply port 4 through a recess part 35. The partition wall 25 is formed with through holes 25*a* for guiding ink A into the differential pressure regulating valve accommodation chamber 33 from the filter chamber 34.

A partition wall 26 having a communication port 26*a* opened to both sides (laterally) is provided between the partition walls 24 and 10. A partition wall 27 having a communication port 27*a* opened laterally is provided in one side of the partition wall 24 (opposite side from the first upper ink storage chamber 16). A communication passage 28 communicating with the communication port 27*a* and extending in a vertical direction is provided between the partition wall 27 and the container main body 2. The communication passage 28 is made to communicate with the filter chamber 34 through a through hole 29 and areas 30 and 30*a*.

According to the described configuration, if the ink cartridge 1 is placed in the cartridge holder of the record apparatus, the lower ink storage chamber 11 is opened to the atmosphere through the through hole 67 and the air flow passage (the area 43, etc.,). The valve body (not shown) in the ink supply port 4 is opened as the ink supply needle (not shown) is inserted.

As the record head consumes ink A, the pressure of the ink supply port 4 falls below a stipulated value and thus a differential pressure regulating valve in the differential pressure regulating valve accommodation chamber 33 is opened (if the pressure of the ink supply port 4 rises above stipulated value, the differential pressure regulating valve is closed), and ink A in the differential pressure regulating valve accommodation chamber 33 flows into the record head through the ink supply port 4.

Further, as ink consumption in the record head proceeds, ink A in the lower ink storage chamber 11 flows into the first upper ink storage chamber 16 through the compartment 19 and the communication flow passage 18.

On the other hand, as ink is consumed, air flows in through the through hole 67 communicating with the atmosphere and the ink level in the lower ink storage chamber 11 lowers. Further, when ink A is consumed and the ink level arrives at the communication port 19*a*, ink from the lower ink storage chamber 11 flows into the first upper ink storage chamber 16 via the communication flow passage 18 together with air. Accordingly, air bubble a is moved up in the first upper ink storage chamber 16 by a buoyant force and only ink A flows into the second upper ink storage chamber 17 through the communication port 41*a* in the lower part of the vertical wall 41. The ink A passes through the communication port 27*a* of the partition wall 27 from the second upper ink storage chamber 17, rises in the communication passage 28, and flows from the communication passage 28 through the through hole 29 and the areas 30 and 30*a* into the upper part of the filter chamber 34.

After this, the ink A in the filter chamber 34 passes through a filter and flows into the differential pressure regulating valve accommodation chamber 33 through the through holes 25*a*. Further, the ink passes through a through hole opened as the differential pressure regulating valve is opened, and then moves down in the recess part 35 and flows into the ink supply port 4. Thus, the ink can be supplied from the ink cartridge to the record head.

Next, the function of the partition wall 62 will be discussed with reference to FIGS. 7(*a*) to 7(*e*).

As ink is consumed, when ink from the lower ink storage chamber 11 flows into the first upper ink storage chamber 16 via the communication flow passage 18 together with air and the air bubble a is moved up in ink A in the first upper ink storage chamber 16, the function of the partition wall 62 is exerted.

That is, as ink A is consumed, the air bubble a enters into the first upper ink storage chamber 16 correspondingly to the ink consumption. The air bubble a is guided by the partition wall 62 placed slantingly with respect to the liquid surface so that the air bubble a is moved to a position away from the sensor accommodation area 65 (FIG. 7(*a*)). The air bubble a accumulates in the upper space as a bubble a' by the action of a surface active agent, etc., contained in the ink.

Figure 7:
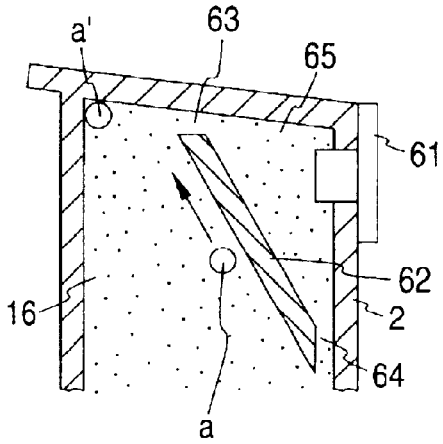
FIGS. 7(*a*) to 7(*e*) are sectional views to describe the function of a partition wall in the ink cartridge according to the embodiment of the invention.
Figure 7:
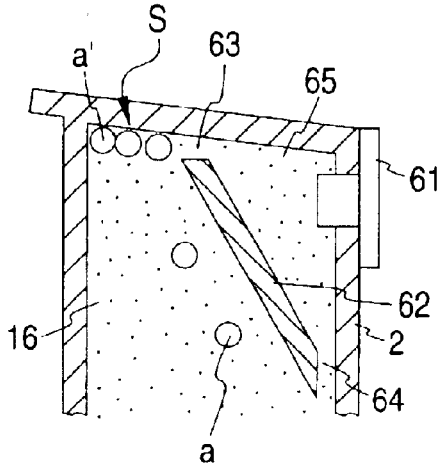
Figure 7:
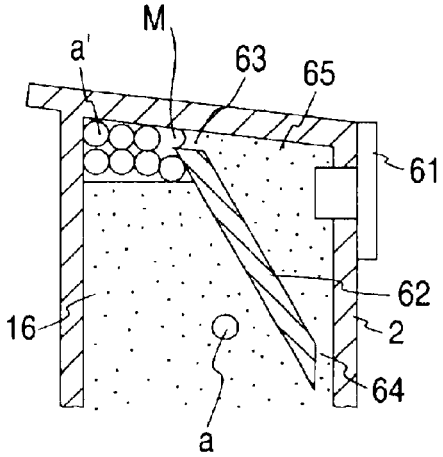
Figure 7:
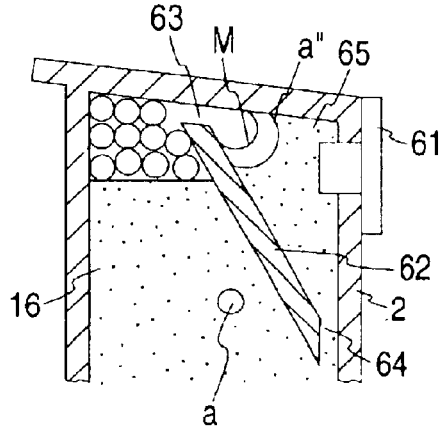
Figure 7:
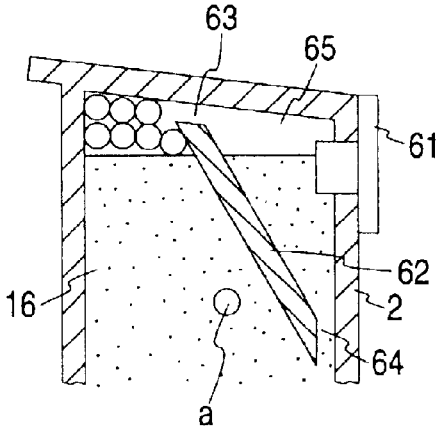

As the number of air bubbles a that have entered is increased in association with the ink consumption, the number of bubbles a' in the upper space is increased (FIG. 7(*b*)) and finally the bubbles a' arrive at the upper gap 63 of the partition wall 62.

If ink A is further consumed in this state, the force of moving the bubbles a' produced by the air bubbles a from space S to the upper gap 63 acts on the air bubbles a' by buoyant force. Since that force is smaller than the capillary force of a meniscus M occurring in the upper gap 63, the bubbles a' cannot pass through the upper gap 63 and are accumulated to swell around the upper gap 63 (FIG. 7(*c*)). The sensor accommodation area 65 is made to communicate with the first upper ink storage chamber 16 through the lower gap 64 of the partition wall 62, but bubbles do not enter the sensor accommodation area 65 through the lower gap 64 and thus the level of ink A in the sensor accommodation area 65 is maintained in the initial state.

When the ink A is furthermore consumed and the flow force of the bubbles a' in the vicinity of the liquid surface of the ink exceeds the limit of the capillary force of the meniscus M in the upper gap 63, the bubbles a' are combined with each other in front of the upper gap 63 into a larger bubble a", which gradually passed through a narrow space of the upper gap 33 and flows out of the upper gap 63 (into the sensor accommodation area 65 while growing outwardly like a soap bubble (FIG. 7(*d*) When the larger bubbles a" grows to a limit point, the larger bubbles a" is destroyed in the sensor accommodation area 65 (FIG. 7(*e*)).

That is, since the sensor accommodation area 65 is formed so as to gradually spread toward the sensor side from the upper gap 63, the bubble a" flowing into the sensor accommodation area 65 is gradually enlarged in the sensor accommodation area 65 and is destroyed.

In this embodiment, the partition wall 62 is disposed so as to form the gradually spreading sensor accommodation area 65, and therefore the bubble a" moving from the upper gap 63 to the sensor accommodation area 65 is readily enlarged and destroyed.

Then, as the number of the bubbles a' increases and the bubbles a' swell in the upper gap 63, the resultant bubble a" is enlarged in the sensor accommodation area 65 and then is destroyed as described above. Each time the bubble a" is destroyed, the ink level in the sensor accommodation area 65 changes so as to correspond to the ink level in the first upper ink storage chamber 16 (FIG. 7(*e*)).

Therefore, in the embodiment, accumulation of bubbles caused by ink A in the sensor periphery is suppressed, so that a large number of small bubbles a' can be reliably prevented from flowing into the area of the liquid level sensor 61 and from being deposited on the liquid level sensor 61, fluctuation in the frequency characteristic of residual vibration for level detection can be suppressed, and the ink level in the ink cartridge can be detected stably and with high accuracy.

In the embodiment, the partition wall 62 is formed as a tilt rib, so that the bubbles a' can be made to flow into the sensor accommodation area 65 from the upper gap 63 and can be gradually enlarged and destroyed by the spread of the sensor accommodation area 65. Accordingly, the spread of spray produced as the bubbles a' are destroyed becomes small and fluctuation in the acoustic impedance caused by spray can be prevented as much as possible and the liquid level can be detected reliably.

In the embodiment, the case where the partition wall 62 is inclined 35 degrees with respect to the attachment face of the liquid level sensor 61 has been described, but the invention is not limited to it. If the partition wall 62 is set at such an angle that it is inclined in a direction in which air bubbles moved up in ink are brought away from the sensor accommodation area 65, for example, at an angle of 30 to 60 degrees, the air bubble a is easily guided by the partition wall 62 from the lower side to the upper side.

It is preferable to set the inclined angle with respect to the liquid surface to be in the range of 30 to 60 degrees. In addition, the liquid surface used here means the liquid surface of ink when the ink cartridge is mounted onto the recording apparatus.

In the embodiment, it is desirable that the distance between the partition wall 62 and the liquid level sensor 61 (shortest dimension) is set to be 8 to 12 mm. If this distance is in that range, erroneous detection of the ink level caused by the swollen bubble coming in contact with the liquid level sensor 61 before the bubble is destroyed can be prevented. The rigidity of the container main body 2 in the periphery of the liquid level sensor can be enhanced and a good detection (vibration) characteristic can be provided in the liquid level sensor 61.

Figure 8:
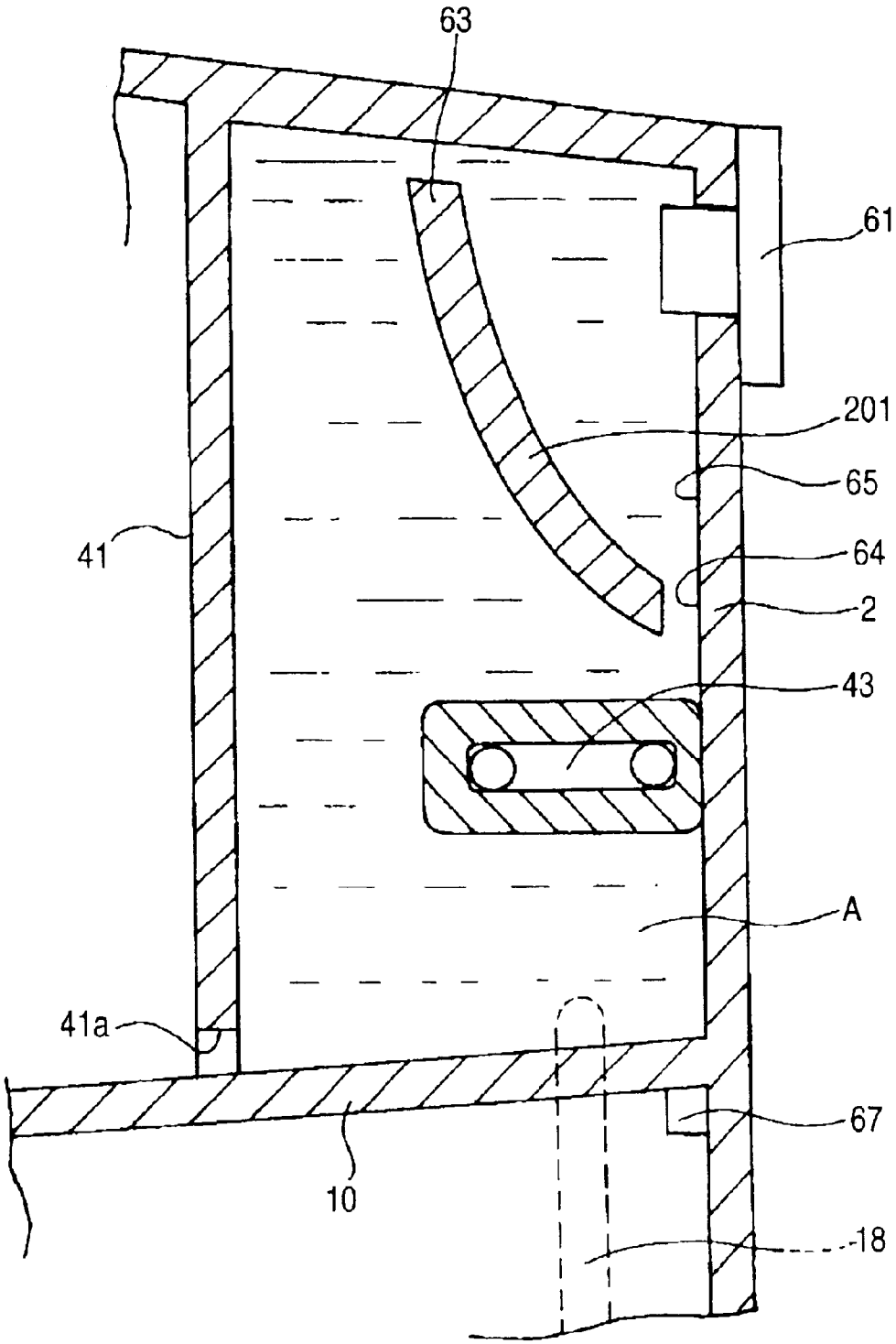
FIG. 8 is a sectional view to show another embodiment of the partition wall in the ink cartridge.
Figure 9:
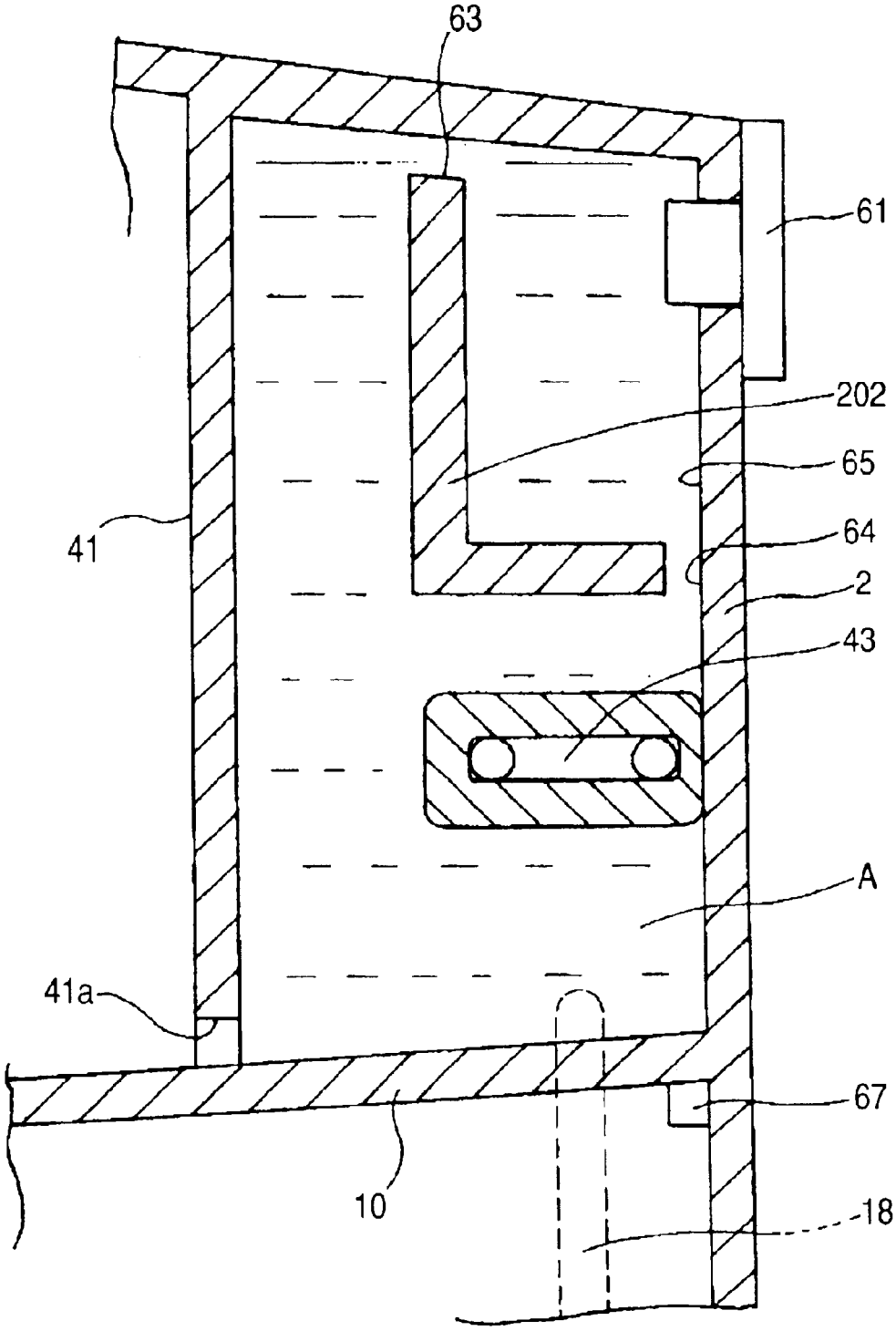
FIG. 9 is a sectional view to show another embodiment of the partition wall in the ink cartridge.

In addition, in the embodiment, the case where the partition wall 62 is a tilt rib has been described, but the invention is not limited to it. If the partition wall 62 is a rib 201 shaped like a circular arc as shown in FIG. 8 or a rib 202 shaped like a hook as shown in FIG. 9, advantages roughly similar to those of the embodiment can also be provided.

Figure 10:
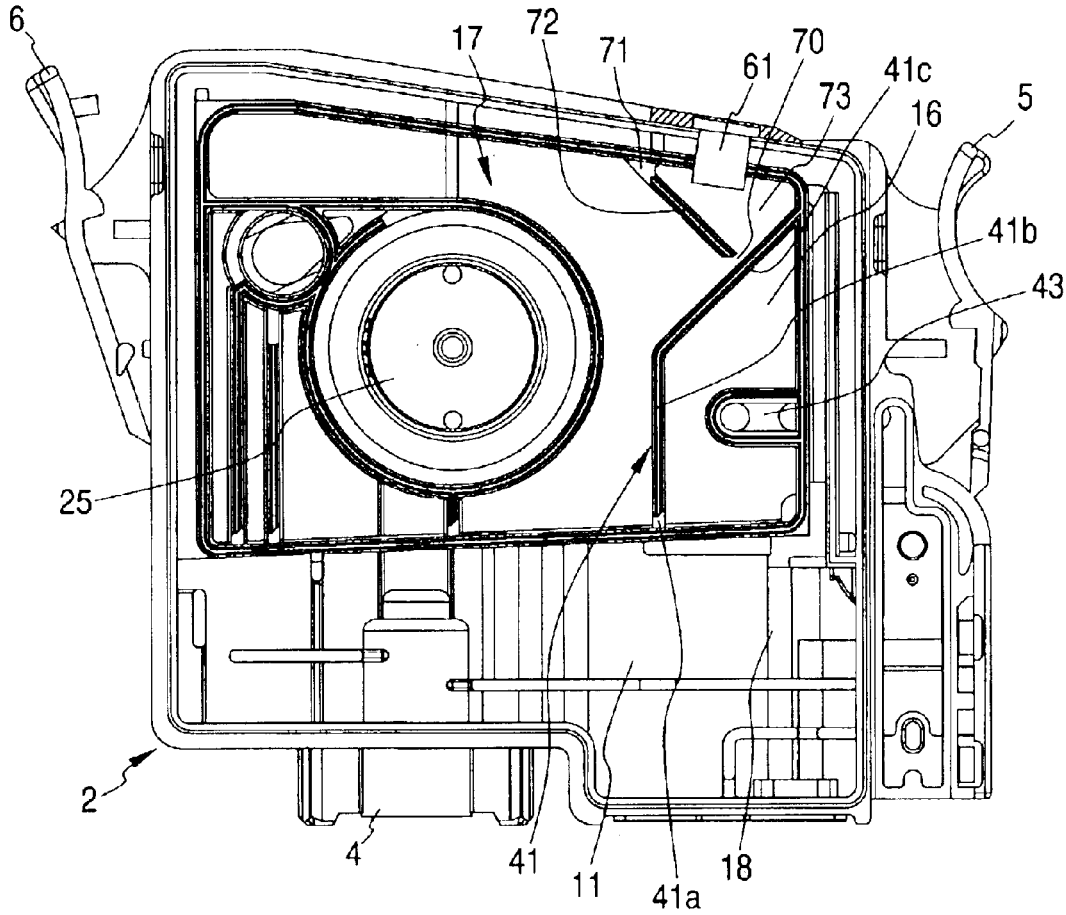
FIGS. 10(*a*) and 10(*b*) are a front view to show another embodiment of an ink cartridge of the invention as the structure of an ink storage chamber, and an enlarged front view of an area in the vicinity of a gap formed in the upper part of the ink cartridge.
Figure 10:
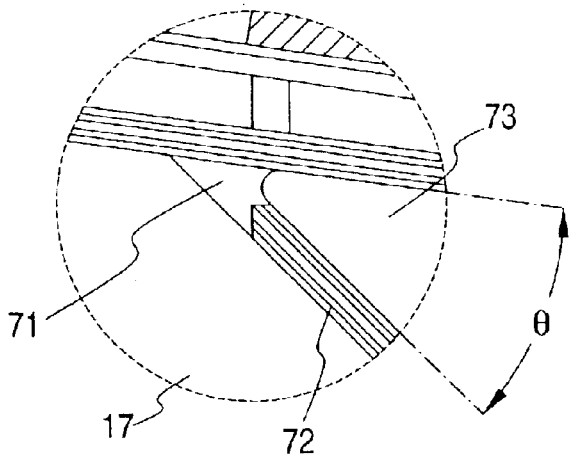

FIG. 10(*a*) shows another embodiment of the invention as the structure of a container main body 2. In the embodiment, a wall 41 for partitioning a first upper ink storage chamber 16 and a second upper ink storage chamber 17 formed above a lower ink storage chamber 11 comprises a lower portion formed as a vertical wall 41*b* and an upper portion formed as a slope 41*c* inclined to the side wall.

A liquid level sensor 61 is placed in the second upper ink storage chamber 17 so as to position within the projection plane of the slope 41*c*, and a slanting wall 72 is formed so as to define a gap 70 between the lower end thereof and the slope 41*c* and a gap 71 in the upper end thereof and to face the liquid level sensor 61.

Consequently, as shown in FIG. 10(*b*), an area of the sensor accommodation chamber 73 in the vicinity of the gap 71 is tapered (enlarged) toward the liquid level sensor 61 at a predetermined angle θ, and therefore when the air bubble is pushed out from the gap 71 into the sensor accommodation chamber 73, the air bubble is easily expanded and then destroyed.

The wall 72 is inclined so that the liquid level sensor 61 is contained within the projection plane and that the distance between the upper part and the liquid level sensor 61 becomes large. The wall 72 has a width selected to such an extent that the second upper ink storage chamber 17 can be partitioned or a width selected to such an extent that an air bubble does not enter from a side. The slope 41*c* and the wall 72 define a sensor accommodation area 73 that is spread and enlarged in the upper part.

Preferably, the lower gap 70 is set to about 0.5 mm to 1 mm, for example, to such an extent that it is narrower than the size of an air bubble occurring in ink and moved up and that it does not interfere with flow down of ink. In this embodiment, since a communication port 41*a* is offset from the lower gap 70 toward the upper gap 71 in the horizontal direction, the lower gap 70 may be set to a larger dimension, preferably less than 3.0 mm.

Figure 11:
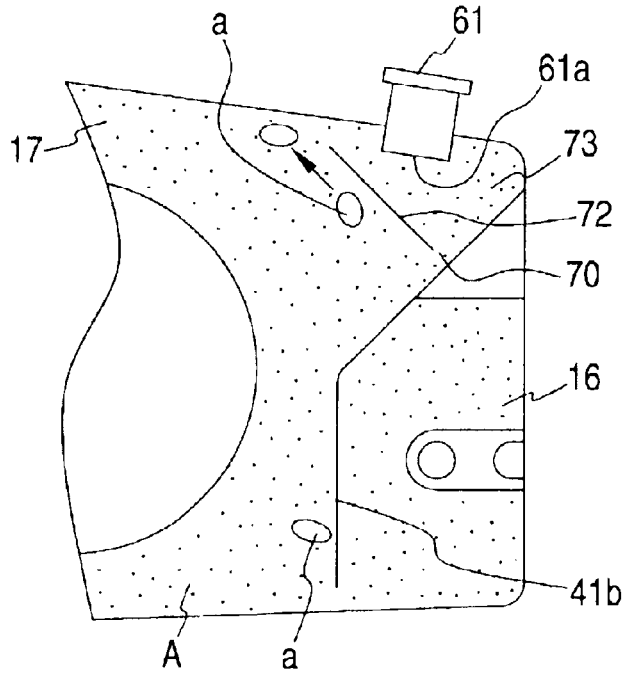
FIGS. 11(*a*) and 11(*b*) are schematic representations to show the ink detection operation in the ink cartridge.
Figure 11:
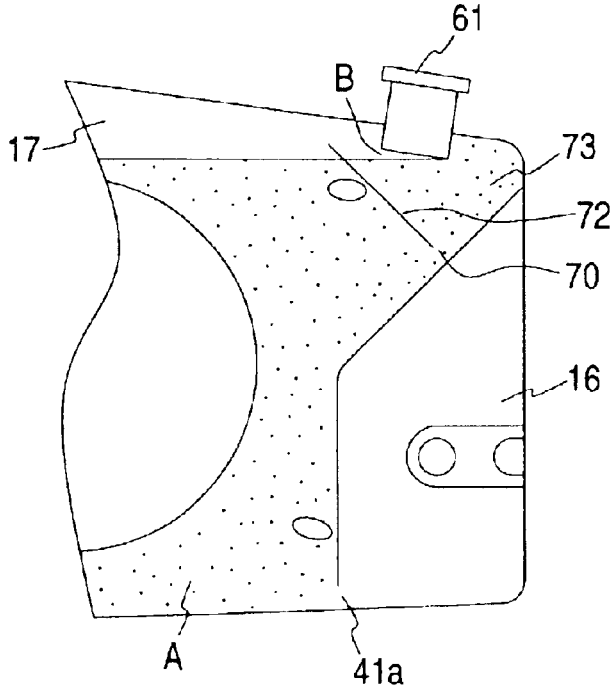

According to the embodiment, as shown in FIG. 11(*a*), ink flowing into the first upper ink storage chamber 16 via a communication flow passage 18 flows through a communication port 41*a* at the bottom of the wall 41 into the second upper ink storage chamber 17. If the ink flowing into the chamber contains an air bubble, the air bubble rises along the vertical wall 41*b* and further rises along the slanting wall 72 in a direction away from the liquid level sensor 61. Accordingly, the air bubble accumulates in the upper part of the second upper ink storage chamber 17 without entering the sensor accommodation area 73. Therefore, if sufficient ink A exists, occurrence of an air layer as the air bubble a enters the sensor accommodation area 73 is prevented.

On the other hand, as ink A is consumed, if ink in the first upper ink storage chamber 16 is entirely consumed and the liquid level of the ink A in the second upper ink storage chamber 17 lowers, ink in the sensor accommodation area 73 flows out from the gap 70 and an air layer B occurs in the upper part of the sensor accommodation area 73, as shown in FIG. 11(*b*).

Accordingly, change occurs in the counter electromotive force produced by the residual vibration of a piezoelectric element 116 forming a part of the liquid level sensor 61, so that the fact that the liquid level of the ink A becomes lower than a detection face 61*a* of the liquid level sensor 61 can be detected.

In the embodiment, the liquid level sensor 61 is placed so that the detection face 61*a* is opposed to the liquid surface of ink, so that the point in time at which the liquid surface of ink leaves the liquid level sensor 61 can be detected more clearly than that in the embodiment described above.

Since the liquid level sensor 61 is placed on the top of the cartridge, leakage of ink from the attachment area of the liquid level sensor 61 can be prevented in the placement state to a record head. Further, the liquid level sensor 61 is positioned on the opened upper face of a carriage even when the ink cartridge is placed on the carriage, so that it is not necessary to lessen the thickness of the sensor unnecessarily, and the flexibility of assembly is enhanced.

In the embodiments described above, the partition wall 63, 72 for preventing entry of an air bubble and destroying the air bubble is formed of a plate member defining gaps from the walls of the container, but similar advantages are provided if a plate member having a mesh or slit having a smaller size than the air bubble is used and the pore size of the mesh or the width of the slit is appropriately adjusted at the upper part and/or the lower part thereof. The partition wall 63, 72 is formed integrally with the container main body, but similar advantages are provided if the partition wall is formed separately from the container main body or is formed integrally with the lid 3.

Figure 12:
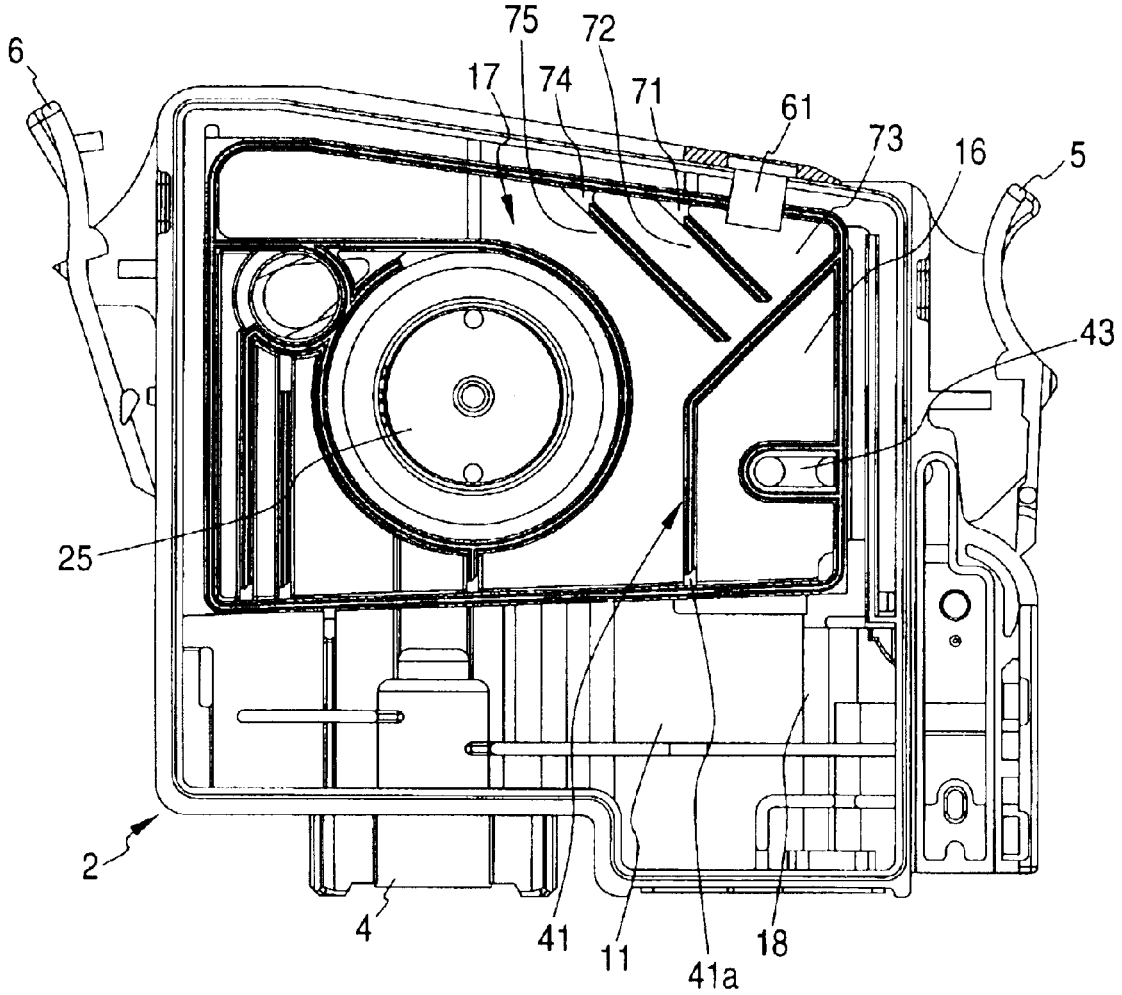
FIG. 12 is a front view to show another embodiment of an ink cartridge of the invention as the structure of an ink storage chamber.

In the embodiment described above, one partition wall defines the sensor accommodation area. However, another partition wall 75 may be placed away from the partition wall 72 in a horizontal direction so as to form a gap 74 similar to the upper gap 63 described above and so as to define an enlarging space in the vicinity of the gap 74 toward the sensor 61, as shown in FIG. 12. In this case, air bubbles are blocked by the outer partition wall 75, and guided to the upper part of the partition wall 75, so that the bubbles can be destroyed by the action of the upper gap 74. Further, a small number of bubbles occurring between the partition wall 75 and a partition wall 73 can be further destroyed by the action of an upper gap 71 of a partition wall 72.

Accordingly, the bubbles are destroyed at the two stages, so that entry of bubbles into a sensor accommodation area 73 can be blocked reliably and air bubbles can be reliably prevented from adhering to a liquid level sensor 61 placed in an upper part.

What is claimed is:

1. An ink cartridge comprising:

a container having at least one ink chamber storing ink therein;

a partition wall disposed in the container, and defining a sensor accommodation area in a part of the ink chamber, the partition wall further defining an upper gap and a lower gap through which the sensor accommodation area is in fluid communication with another part of the ink chamber;

a liquid level sensor comprising a piezoelectric element, which is disposed in the sensor accommodation area, wherein the upper gap is narrower than the size of an air bubble occuring in the ink, whereby blocking entry of the bubble into the accommodation area is blocked, and wherein the upper gap has a size adapted to destroy the bubble when the bubble is pushed into the accommodation area via the upper gap.

2. The ink cartridge according to claim 1, wherein the partition wall is inclined with respect to liquid surface of ink.

3. An ink cartridge for supplying ink to a record head through an ink supply port wherein space of a container is divided into a plurality of ink storage chambers by a dividing partition wall, the ink storage chambers are connected by a communication hole, and a most upstream one of the ink storage chambers is opened to the atmosphere, the ink cartridge comprising:

a liquid level sensor comprising a piezoelectric element, which is disposed at an ink level detection position in a downstream one of the ink storage chambers; and a liquid level sensor accommodation area for accommodating the liquid level sensor therein, the accommodation area being defined by a partition wall that is at least partly inclined with respect to liquid surface of ink, and that forms upper and lower communication gaps, wherein the upper gap is narrower than the size of an air bubble occurring in the ink, whereby blocking entry of the bubble into the accommodation area, and wherein the upper gap has a size adapted to destroy the bubble when the bubble is squeezed into the accommodation area via the upper gap.

4. The ink cartridge as claimed in claim 1 or 3, wherein a plurality of the partition walls are disposed to be separated one from another in a horizontal direction.

5. The ink cartridge as claimed in claim 1 or 3, wherein the partition wall is disposed so that a part of the accommodation area in the vicinity of the upper gap is spread and enlarged toward the liquid level sensor.

6. The ink cartridge as claimed in claim 1 or 3, wherein the upper gap has a size of 0.5 mm to 1 mm.

7. The ink cartridge as claimed in claim 1 or 3, wherein the partition wall is formed as a flat plate.

8. The ink cartridge as claimed in claim 7, wherein the partition wall has an angle of 30 to 60 degrees with respect to a horizontal plane.

9. The ink cartridge as claimed in claim 1 or 3, wherein the partition wall has a circular arc shape in cross section.

10. The ink cartridge as claimed in claim 1 or 3, wherein the partition wall has a hook shape in cross section.

11. The ink cartridge as claimed in claim 1 or 3, wherein a distance between the upper gap of the partition wall and the liquid level sensor is at least 8 mm.

12. The ink cartridge as claimed in claim 1 or 3, wherein the container comprises a container main body and a lid for sealing an opening of the container main body, and the partition wall is molded integrally with the container main body or the lid.

13. The ink cartridge as claimed in claim 1 or 3, wherein the liquid level sensor is disposed in an upper area or a side area of the ink storage chamber.

14. An ink cartridge comprising:

a container having at least one ink chamber storing ink therein;

a partition wall disposed in the container, and defining a sensor chamber in a part of the ink chamber, the partition wall further defining an upper gap and a lower gap through which the sensor chamber is in fluid communication with another part of the ink chamber;

a liquid level sensor comprising a piezoelectric element, which is disposed in the sensor chamber, wherein air bubbles accumulate in front of the upper gap and wherein one of the bubbles is enlarged as it is pushed into the accommodation area via the upper gap, and the enlarged bubble is destroyed by the upper gap, the upper gap is in a range of 0.5 mm to 1 mm.

15. The ink cartridge according to claim 14, wherein the lower gap is less than 0.5 mm.

16. The ink cartridge according to claim 14, further comprising:

a communication port opened to the ink chamber so that air can be introduced into the chamber through the communication port, wherein the communication port is offset from the lower gap toward the upper gap in a horizontal direction.

17. The ink cartridge according to claim 16, wherein lower gaps is less than 3 mm.

18. The ink cartridge according to claim 14, wherein a minimal distance between the partition wall and the liquid level sensor is 8 mm or more.

19. The ink cartridge according to claim 14, wherein the partition wall is at least partly inclined with respect to a horizontal direction.

20. The ink cartridge according to claim 19, wherein an inclination angle is in a range of 30 to 60 degrees.

21. The ink cartridge according to claim 14, wherein the partition wall has a planar shape, an arcuate shape or an L-shape.

22. The ink cartridge according to claim 14, wherein the partition wall includes a mesh plate.

23. The ink cartridge according to claim 22, wherein at least one of the upper gap and the lower gap is defined by a mesh size of the mesh plate.

24. The ink cartridge according to claim 14, wherein the partition wall has a slit.

25. The ink cartridge according to claim 24, wherein at least one of the upper gap and the lower gap is defined by a width of the slit.

26. The ink cartridge according to claim 14, wherein the at least one ink chamber includes an upstream ink chamber communicable with the atmosphere, and a downstream ink chamber communicating with the upstream ink chamber via a communication flow passage, and the sensor chamber is defined in the part of the downstream ink chamber.

27. The ink cartridge according to claim 26, wherein the at least one ink chamber further includes an intermediate ink chamber, and the downstream ink chamber communicates with the upstream ink chamber via the communication flow passage and the intermediate ink chamber.

* * * * *